United States Patent [19]

Crosthwaite

[11] Patent Number: 4,696,069

[45] Date of Patent: Sep. 29, 1987

[54] SOFA BED

[75] Inventor: Robert P. Crosthwaite, Lethbridge, Canada

[73] Assignee: Ducan Steel Benders Ltd., Lethbridge, Canada

[21] Appl. No.: 869,514

[22] Filed: Jun. 2, 1986

[51] Int. Cl.[4] ..... A47C 17/04

[52] U.S. Cl. ..... 5/37 R; 5/37 C; 5/41; 5/47

[58] Field of Search ..... 5/37 B, 37 C, 37 R, 5/41, 47, 48, 18 R, 44 R

[56] References Cited

U.S. PATENT DOCUMENTS

| | | | |
|---|---|---|---|
| 754,142 | 3/1904 | Hunt | 5/37 R |
| 2,142,578 | 1/1939 | Vallone | 5/44 B |
| 2,859,798 | 11/1958 | Carte | 5/37 R |
| 3,634,893 | 1/1972 | Hern et al. | 5/37 R |
| 3,657,747 | 4/1972 | Rogers, Jr. et al. | 5/37 R |
| 4,001,901 | 1/1977 | Quakenbush | 5/37 R |
| 4,204,288 | 5/1980 | Villa et al. | 5/47 |
| 4,321,716 | 3/1982 | Shrock | 5/37 R |
| 4,512,048 | 4/1985 | Isham et al. | 5/37 R |
| 4,569,093 | 2/1986 | Hermann | 5/37 R |
| 4,608,722 | 9/1986 | Zorzetto | 5/37 R |

*Primary Examiner*—Cornelius J. Husar

*Assistant Examiner*—Anthony Knight

*Attorney, Agent, or Firm*—Harold H. Dutton, Jr.; George H. Dunsmuir

[57] ABSTRACT

In general, sofa beds are complicated structures and are commonly difficult to operate. A relatively simple sofa bed includes a pair of generally U-shaped bases for resting on the floor, each base being defined by vertical front and rear arms, a rearwardly inclined cross bar extending between the front and rear arms, a track mounted on the crossbar, a rectangular seat frame connected to the base by a pair of link arms, one of which is pivotally connected to the front arm of the base, and the other of which is connected to the track, so that the front end of the seat frame can be lifted and rotated forwardly from the inclined sofa position to the horizontal bed position, and the back frame pivotally connected by one link arm to the rear arm of the base and by another, generally C-shaped link arm to the rear end of the seat frame, whereby the back frame is normally supported in a steeply inclined sofa position, but during movement of the seat from the sofa position to the bed position corresponding movement of the back frame occurs from the inclined, sofa position to the horizontal bed position.

7 Claims, 8 Drawing Figures

SOFA BED

BACKGROUND OF THE INVENTION

This invention relates to a sofa bed.

Sofas or couches which are convertible into beds have long been available. Examples of such devices are found in the U.S. Pat. Nos. 2,142,578, which issued to J. M. Vallone on Jan. 3, 1939; 3,634,893, which issued to J. F. Hearn et al on Jan. 18, 1972; 4,001,901, which issued to Howard M. Quakenbush on Jan. 11, 1977 and 4,321,716, which issued to F. J. Shrock on Mar. 30, 1982. In general, the patented devices are structurally complicated, difficult to operate or rely on springs for their operation.

The object of the present invention is to provide a relatively simple sofa bed, i.e. a sofa which can be converted into a bed, and which is easy to operate.

SUMMARY OF THE INVENTION

Accordingly, the present invention relates to a sofa bed comprising generally U-shaped base means for resting on a floor, said base means including substantially vertical front and rear arm means; rearwardly inclined track means extending between said front arm means and said rear arm means; seat frame means supported by said base means; back frame means supported by said base means and by said seat frame means; first link means pivotally connected to the top end of said front arm means and to said seat frame means between the front end and middle thereof; second link means rigidly connected to the rear end of said seat frame means, and slidably and pivotally connected to said track means, whereby said seat frame means can be moved from a rearwardly inclined sofa position to a horizontal bed position by lifting of the front end of said seat frame means, rotation of the first link means from a rearwardly and downwardly extending position to a forwardly extending, substantially horizontal position, and sliding of said second link means forwardly along said track means; third, generally C-shaped link means rigidly connected at one end to the bottom end of said back frame means and pivotally connected to said seat frame means at a location forwardly of said second linkage means for normally supporting said back frame means steeply inclined with respect to said seat frame means, and fourth link means pivotally connected to said rear arm means and to the bottom end of said back frame means thereof, whereby movement of said seat frame means from the sofa position to the bed position causes corresponding movement of the back frame means from the inclined, sofa position to the horizontal, bed position.

BRIEF DESCRIPTION OF THE DRAWINGS

The invention will now be described in greater detail with reference to the accompanying drawings which illustrate a preferred embodiment of the invention, and wherein.

DESCRIPTION OF THE PREFERRED EMBODIMENT(S) STRUCTURE

Figure 1:
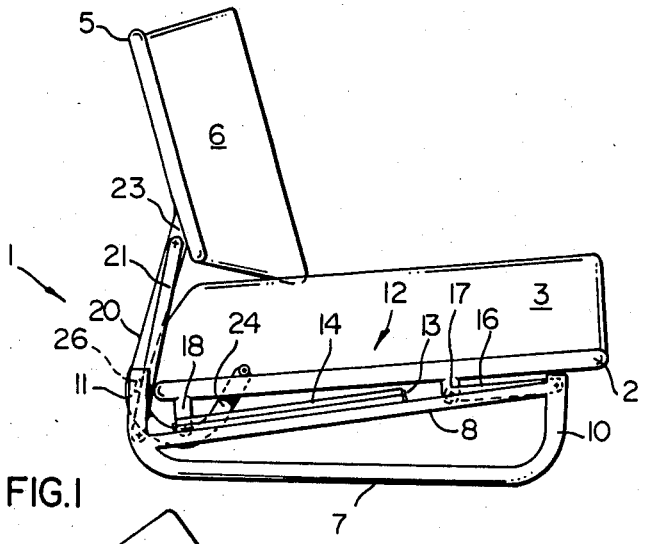
FIG. 1 is a side elevation view of a sofa bed in accordance with the present invention is the sofa position.
Figure 2:
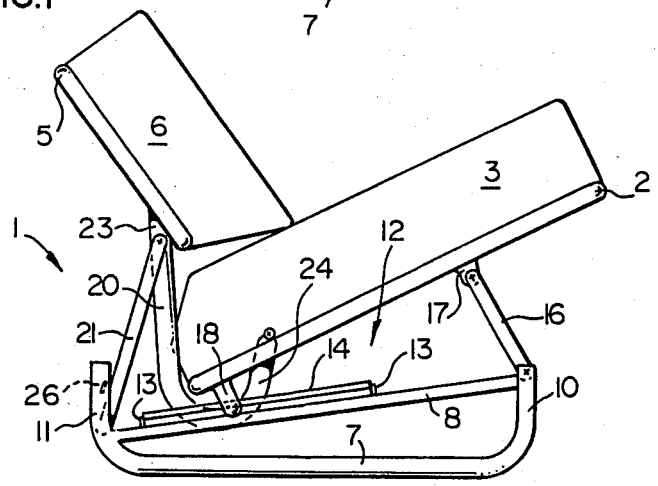
FIG. 2 is a side elevation view of the sofa bed of FIG. 1 during movement from the sofa to the bed position.
Figure 3:
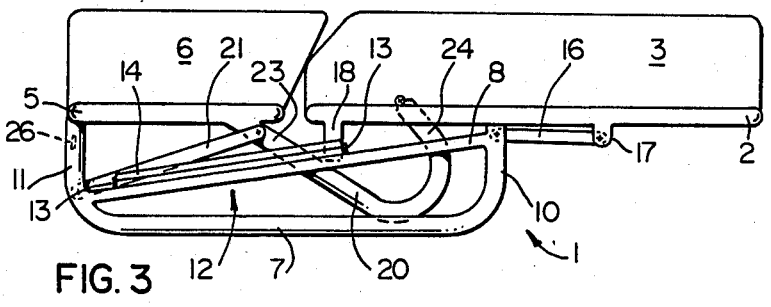
FIG. 3 is a side elevation view of the sofa bed of FIGS. 1 and 2 in the bed position.

With reference to FIGS. 1 to 3, a sofa bed in accordance with the present invention includes a pair of end frames generally indicated at 1. For the sake of simplicity, only one frame 1 is shown in FIGS. 1 to 3, and the description of FIGS. 1 to 3 is restricted to such frame 1. The frame 1 is designed to support a rectangular bed frame 2 with a cushion or cushions 3 thereon, and a sofa back or backrest 5, with a cushion or cushions 6 thereon. For the most part, the frame 1 , 2 and 5 are formed of tubular metal.

The frame 1 includes a generally U-shaped base 7 for resting on the floor. A crossbar 8 extends diagonally between the top of the front arm 10 of the base 7 and the bottom end of the rear arm 11 of the base 7. A track generally indicated at 12 is provided on the crossbar 8. The track 12 includes a pair of lugs 13 extending upwardly from the crossbar 8 for supporting a rod 14 parallel to and spaced from the crossbar 8. One end of a link arm 16 is pivotally connected to the top end of the front leg 10 of the base 7, and the other end of the arm 16 is pivotally connected to a lug 17 extending downwardly from the bed frame 2 between the front edge and middle thereof. A second lug 18 extends downwardly from the rear end of the seat frame 2 for supporting a rod (not shown) which extends horizontally into the track 12. Thus, as described hereinafter in greater detail, the seat portion of the sofa bed is movable between the sofa position (FIG. 1) and the bed position (FIG. 3).

The seat back frame 5 is pivotally connected to both the seat frame 2 and to the base 7 by a pair of links 20 and 21. One of the links 20 is generally C-shaped and includes a longer arm 23, the top, rear end of which is fixedly connected to the bottom end of the back frame 5, and a shorter arm 24, the front free end of which is pivotally connected to the seat frame 2 near the back end thereof, but in front of the lug 18. One end of the link 21 is pivotally connected to the top end of arm 23 of the link 20, and the other end of such link 21 is pivotally connected to the leg 11 of the base 7 near the bottom end thereof. A stop 26 (FIG. 3) extends inwardly from the leg 11 of the base 7 for engaging the link 21 to limit movement thereof in one direction (rearwardly).

Figure 4:
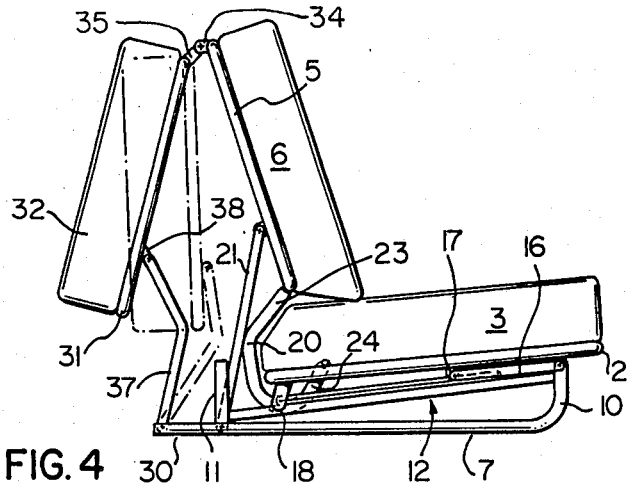
FIG. 4 is an end elevation view of a second embodiment of the sofa bed of the present invention in the sofa position.
Figure 5:
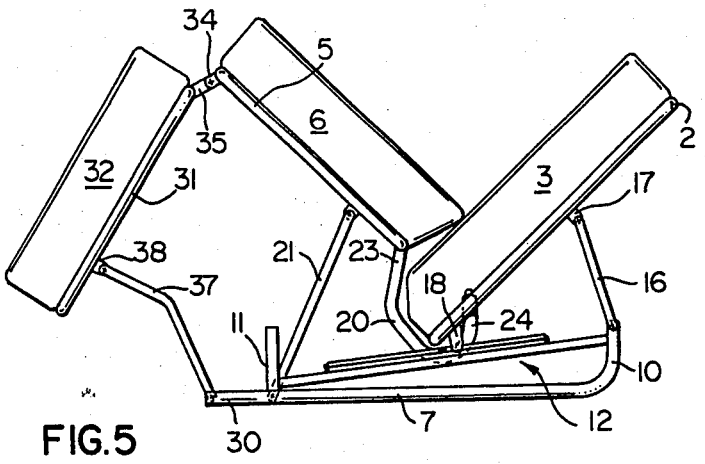
FIG. 5 is a end elevation view of the sofa bed of FIG. 4 in a position intermediate the sofa and bed positions.
Figure 6:
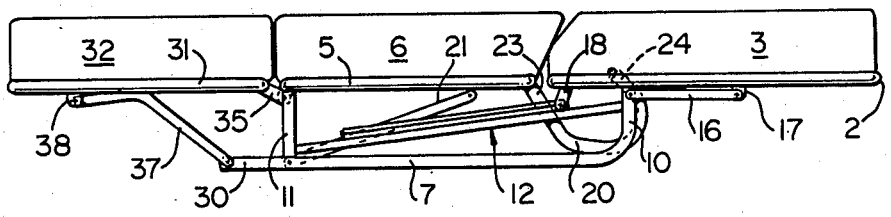
FIG. 6 is an end elevation view of the sofa bed of FIGS. 4 and 5 in the bed position.

Referring to FIGS. 4 to 6, wherever possible the reference numerals of FIGS. 1 to 3 have been used to identify the same or similar elements. In the bed soda of FIGS. 4 to 6, the base 7 includes a rearwardly extending, horizontal arm 30. The rear leg 11 of the base 7 is defined by a post extending upwardly from the bottom of the base 7. The arm 23 of the link 20 is connected to the bottom of the seat back frame 5, and the top end of the link 21 is pivotally connected to the frame 5 above the bottom thereof (in the sofa position). An auxiliary rectangular frame 31 carrying a cushion or cushions 32 is pivotally connected to the frame 5 and to the base 7. For such purpose, a lug 34 extends outwardly from the top rear end of the frame 5. A short lug 35 extends forwardly and upwardly from the frame 31, and is pivotally connected to the lug 34. Another link 37, which defines a shallow V, is pivotally connected at one end to the outer end of the arm 30 of the base 7 and at the other end to a short lug 38 on the bottom rear of the frame 31.

OPERATION

Figure 7:
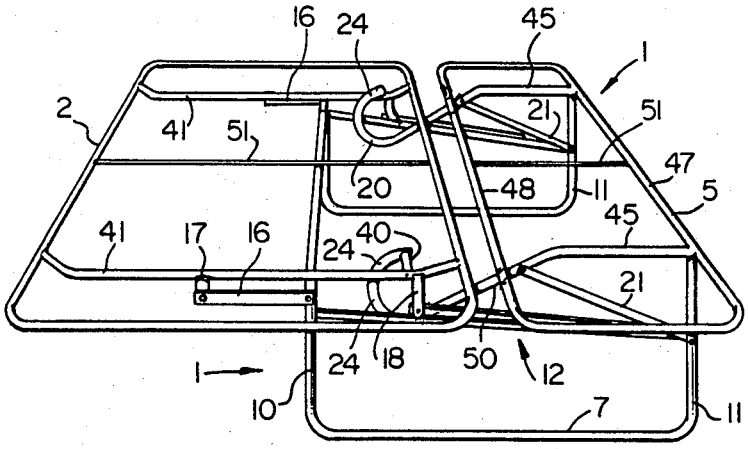
FIG. 7 is a perspective view from above and one end of a sofa bed frame similar to the apparatus of FIGS. 1 to 3 in the bed position.

Referring to FIG. 7 a sofa bed similar to that shown in FIGS. 1 to 3 includes sleeves 40 (one shown) extending outwardly from the free ends of arms 24 of links 20 for receiving bolts (not shown) for pivotally connecting the arms 24 to crossbars 41 of the seat frame 2. A lug 17 extends outwardly from each crossbar 41 for pivotally supporting the links 16. The tubes 41 are welded to the seat frame 2. The link 20 is integral with a crossbar 45 extending between the top and bottom 47 and 48, respectively of the back frame 5. A short arm (not shown) extends between the crossbar 45 and a sleeve 50 on the bottom end 48 of the frame 5. Additional crossbars 51 extend between the front and rear or top and bottom ends of the frames 2 and 5. The link 21 extends between the middle of the rear leg 11 of the base 7 and the crossbar 45 near where the latter curves to form the link 20.

In use, with the frames 2 and 5 in the bed position (FIG. 7), the front or outer end of the seat frame 2 is lifted to cause the link 16 to rotate around the top end of the leg 10. At the same time, the rear end of the seat frame 2 causes upward movement of the link 20 and rotation of the rear frame 5 around the longitudinal axis of the sleeves 40 from the horizontal, bed position towards the steeply inclined sofa position. During such rotation the outer or top end 47 of the rear frame 5, which normally rests on the top ends of the legs 11 rises towards the inclined position. By continuing to rotate the link 16 around the top end of the leg 10, the lug 18 is caused to slide rearwardly in the track 12, and the angle of inclination of the back frame 5 continues to approach the vertical. When the seat and back frames 2 and 5 have reached the sofa position (FIG. 1) the link 16 has passed over centre, which positively locks the sofa bed in the sofa position. Rearward movement of the links 21 are restricted by the stops 26 (FIG. 3), i.e. the links 16 and stops 26 provide positive locks for releasably retaining the sofa bed in the sofa position.

In the sofa position, the pivot point between the arm 16 and the lug 17 is below a line through the pivot points between the arm 16 and the leg 10, and the arm 24 of the link 20 and the frame 2. In such position, the link 21 bears against the stop 26. During initial raising of the front of the seat frame 2 to a point where the pivot point between the arm 16 and the lug 17 is slightly above the above-mentioned line, the link 21 pivots around the bottom of the leg 11 pressing against the stop 26. The rear leg 11 is slightly resilient to allow rearward movement of the stop 26. Further movement of the seat frame 2 towards the bed position, i.e. movement of the arm 16 to the under centre position, causes the link 21 to move forwardly away from the stop 26, thus releasing the lock completely. The lock relies on over centering of the arm 16 which provides for the positive locking of the sofa bed in the seat position.

In order to return the sofa bed to the bed position, the procedure is reversed, i.e. the front end of the seat frame 2 is grasped and lifted to rotate the link 16 around the top end of the front leg 10 which releases the over centre lock until both of the frames 2 and 5 are in the horizontal position (FIGS. 3 and 7).

It will be appreciated that the usual wire springs or flexible strips of material extend between the front and rear or top and bottom ends of the frames 2 and 5 for supporting the cushions 3 and 6. For the sake of simplicity, such elements have been omitted from the drawings.

Figure 8:
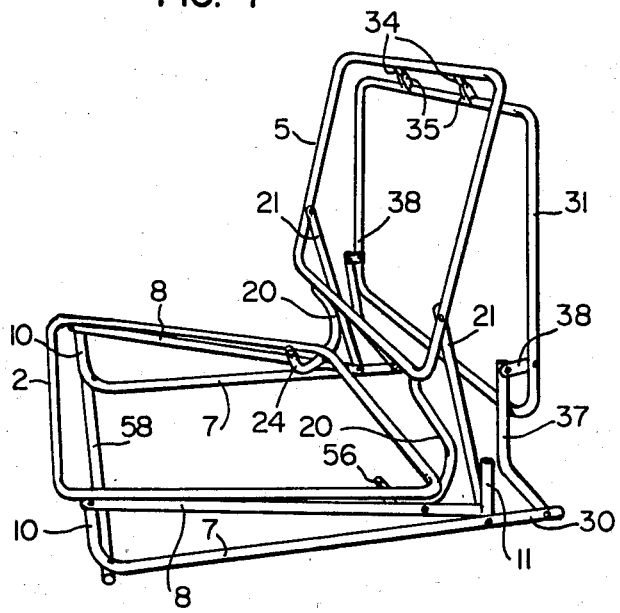
FIG. 8 is a perspective view from above and one end of a sofa bed frame similar to that used in the apparatus of FIGS. 4 to 6 in the sofa position, with parts omitted.

The sofa bed of FIG. 8 is similar to that of FIGS. 4 to 6. Sleeves 56 are provided on the front, bottom ends of the links 20 for pivotally connecting the links to the seat frame 2. A reinforcing bar 58 extends longitudinally between the bottom ends of the front legs 10 of the bases 7. For the sake of simplicity, the tracks 12 have been omitted from FIG. 8.

The basic operation of the second embodiment of the invention is similar to that of the first embodiment. Starting from the sofa position (FIG. 8), as the seat frame 2 moves forwardly, the back frame 5 also swings forwardly on links 21, and the lugs 34 and 35 draw the top end of the auxiliary frame 31 downwardly while the rear end thereof and the link 37 pivot around the bottom rear end (extension 30) of the base 7 to the horizontal positon (FIG. 6). When refolded to the sofa position (FIG. 4), the auxiliary frame 31 will be spaced from the seat frame 5. Alternatively, as shown in phantom outline in FIG. 4, the auxiliary frame 31 can be pivoted to a position closer to the rear frame 5 in the sofa position to leave additional storage space behind the sofa bed.

What I claim is:

1. A sofa bed comprising generally U-shaped base means for resting on a floor, said base means including substantially vertical front and rear arm means; rearwardly inclined track means extending between said front arm means and said rear arm means; seat frame means supported by said base means; back frame means supported by said base means and by said seat frame means; first link means pivotally connected to the top end of said front arm means and to said seat frame means between the front end and middle thereof; second link means rigidly connected to the rear end of said seat frame means, and slidably and pivotally connected to said track means, whereby said seat frame means can be moved from a rearwardly inclined sofa position to a horizontal bed position by lifting the front end of said seat frame means, rotation of the first link means from a rearwardly and downwardly extending position to a forwardly extending, substantially horizontal position, and sliding of said second link means forwardly along said track means; third generally C-shaped link means rigidly connected at one end to the bottom end of said back frame means and pivotally connected to said seat frame means at a location forwardly of said second link means for normally supporting said back frame means steeply inclined with respect to said seat frame means; and fourth link means pivotally connected to said rear arm means and to said back frame means near the bottom thereof, whereby movement of said seat frame means from the sofa position to the bed position causes corresponding movement of the back frame means from the inclined, sofa position to the horizontal, bed position.

2. A sofa bed according to claim 1, including horizontal arm means extending rearwardly from said rear arm means of said base means; auxiliary frame means supported by said base means; fifth link means pivotally connecting the front end of said auxiliary frame means to the top end of said back frame means; and sixth link means pivotally connecting the rear end of said horizontal arm means to the bottom end of said auxiliary frame means, whereby, during movement of said back frame means between the sofa and the bed positions, said auxiliary frame means moves in a corresponding manner between inclined storage position behind said back frame means and a horizontal bed position parallel to and proximate said back frame means.

3. A sofa bed according to claim 1, wherein said fourth link means is pivotally connected to said third link means near the top end thereof.

4. A sofa bed according to claim 1, including crossbar means extending between front and rear sides of said seat frame means, said crossbar means being integral with said third link means.

5. A sofa bed according to claim 4, wherein said fourth link means extends between said rear arm means of the base means and said crossbar means.

6. A sofa bed according to claim 1, including lock means for releasably locking said sofa bed in the sofa position.

7. A sofa bed according to claim 6, wherein said lock means includes stop means on said rear arm means for limiting rearward movement of said fourth link means to a position in which said first link means is inclined rearwardly in an over centre locked position, whereby initial upward movement of said seat frame means causes pressing of said fourth link means against said stop means, and continued movement of the first link means to an under centre position releases said seat frame means.

* * * * *